US008276676B2

(12) United States Patent
Hriscu et al.

(10) Patent No.: US 8,276,676 B2
(45) Date of Patent: Oct. 2, 2012

(54) PRESSURE-ACTIVATED VALVE FOR HYBRID COILED TUBING JOINTED TUBING TOOL STRING

(75) Inventors: Iosif Joseph Hriscu, Duncan, OK (US); Michael Brent Bailey, Duncan, OK (US); Muhammad Asif Ehtesham, Duncan, OK (US); Robert Howard, Duncan, OK (US); Robert Lee Pipkin, Marlow, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 240 days.

(21) Appl. No.: 12/713,256

(22) Filed: Feb. 26, 2010

(65) Prior Publication Data

US 2011/0209881 A1 Sep. 1, 2011

(51) Int. Cl.
*E21B 19/00* (2006.01)

(52) U.S. Cl. ..... 166/386; 166/85.4; 166/332.8; 166/242.2

(58) Field of Classification Search ..... 166/85.4, 166/80.1, 386, 332.8, 242.2
See application file for complete search history.

(56) References Cited

U.S. PATENT DOCUMENTS

| | | | | |
|---|---|---|---|---|
| 2,921,601 | A | 1/1960 | Fisher, Jr. | |
| 3,799,258 | A * | 3/1974 | Tausch | 166/72 |
| 3,955,624 | A | 5/1976 | Fredd et al. | |
| 4,058,165 | A | 11/1977 | Holden et al. | |
| 5,044,443 | A | 9/1991 | Churchman et al. | |
| 5,803,177 | A | 9/1998 | Hriscu et al. | |
| 6,158,516 | A | 12/2000 | Smith et al. | |
| 6,196,325 | B1 | 3/2001 | Connell et al. | |
| 6,253,842 | B1 | 7/2001 | Connell et al. | |
| 6,305,467 | B1 | 10/2001 | Connell et al. | |
| 6,390,199 | B1 | 5/2002 | Heijnen | |
| 6,688,389 | B2 | 2/2004 | Connell et al. | |
| 6,808,023 | B2 * | 10/2004 | Smith et al. | 166/386 |
| 6,877,558 | B2 | 4/2005 | Connell et al. | |
| 7,337,852 | B2 | 3/2008 | Manke et al. | |
| 7,405,998 | B2 | 7/2008 | Webb et al. | |
| 7,648,179 | B2 | 1/2010 | Webb et al. | |

(Continued)

FOREIGN PATENT DOCUMENTS

| | | | |
|---|---|---|---|
| EP | 2108780 | A1 | 10/2009 |
| GB | 2163795 | A | 3/1986 |
| WO | 9919602 | A2 | 4/1999 |

OTHER PUBLICATIONS

Patent application entitled "Selectively activatable and deactibatable wellbore pressure isolation device," by Muhammad Asif Ehtesham, et al., filed Apr. 15, 2011 as U.S. Appl. No. 13/087,810. Foreign communication from a related counterpart application—International Search Report and Written Opinion, PCT/GB2011/000265, Mar. 26, 2012, 11 pages.

*Primary Examiner* — Nicole Coy
(74) *Attorney, Agent, or Firm* — John W. Wustenberg; Conley Rose, P.C.

(57) ABSTRACT

Embodiments of the hybrid tool string include coiled tubing and jointed tubing, as well as a means typically located at the connection of the coiled and jointed tubing for sealing the fluid flowpath through the bore of the hybrid tool string. Embodiments of the hybrid tool string may use a pressure-activated valve tool attached in series between the coiled tubing and the jointed tubing, which allows for sealing of the bore by application of pressure. Embodiments of the pressure-activated valve tool may use a flapper in conjunction with a sleeve to seal the bore. The novel hybrid tool string may be used to service a well.

28 Claims, 5 Drawing Sheets

U.S. PATENT DOCUMENTS

| | | | | |
|---|---|---|---|---|
| 7,866,400 | B2 | 1/2011 | Steele et al. | |
| 7,963,342 | B2 * | 6/2011 | George | 166/386 |
| 2005/0236154 | A1 * | 10/2005 | Tudor et al. | 166/308.1 |
| 2006/0070744 | A1 * | 4/2006 | Smith | 166/386 |
| 2008/0078553 | A1 * | 4/2008 | George | 166/332.8 |
| 2008/0083536 | A1 * | 4/2008 | Cavender et al. | 166/302 |
| 2010/0181079 | A1 * | 7/2010 | Johnson et al. | 166/386 |
| 2011/0073295 | A1 | 3/2011 | Steele et al. | |

* cited by examiner

PRESSURE-ACTIVATED VALVE FOR HYBRID COILED TUBING JOINTED TUBING TOOL STRING

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF INVENTION

The present invention is directed generally to a pressure-activated valve tool, and more specifically to a pressure-activated valve tool used in a hybrid tool string, having coiled tubing and jointed tubing, for use downhole.

BACKGROUND

In downhole oil and gas operations, it may be useful to join coiled tubing and jointed tubing to form a hybrid downhole tool string. The present invention improves the safety of such a hybrid tool string, and may be useful in facilitating disassembly of the connection between the coiled tubing and the jointed tubing of the hybrid tool string.

SUMMARY

In one aspect, the disclosure includes a method of operating a hybrid coiled tubing-jointed tubing downhole tool string, comprising coiled tubing connected directly or indirectly to jointed tubing and having a fluid flowpath therethrough, comprising the steps of: retracting the tool string to dispose the connection of the coiled tubing to the jointed tubing in a section of the well capable of being isolated (typically between two blow-out preventers or between two stripper packers); isolating the section of the well containing the coiled tubing-jointed tubing connection (such as between the blowout preventers) to allow for pressurization of the section; and sealing the fluid flowpath within the tubing string at the coiled tubing-jointed tubing connection; wherein the fluid flowpath is operable to be sealed by pressurizing the isolated section (with the connection disposed in the isolated section). In an embodiment, the coiled-tubing-jointed tubing connection comprises a pressure-activated valve operable to seal the fluid flowpath, and in another specific embodiment the pressure activated valve comprises a flapper, an upper seal, a lower seal, and a port, and the upper seal has a surface area greater than that of the lower seal.

In another aspect, the disclosure includes a method of operating a hybrid coiled tubing-jointed tubing downhole tool string, comprising the steps of: forming up jointed tubing; attaching a pressure-activated valve tool atop the jointed tubing; and attaching coiled tubing atop the pressure-activated valve tool. In one embodiment, attaching coiled tubing atop the pressure-activated valve tool comprises attaching a splined quick-connector atop the tool, attaching a double slip coiled tubing connector atop the splined quick-connector, and attaching coiled tubing to the double slip coiled tubing connector. In another embodiment, the method might further comprise any or all of the following: unspooling and injecting (running-in) coiled tubing downhole to move the jointed tubing to a desired downhole depth; pumping fluid through the downhole tool string (wherein fluid is abrasive/corrosive/erosive or wherein fluid is fracturing fluid); repositioning the jointed tubing by injecting (running-in) and/or retracting (running-out) the coiled tubing; injecting (running-in) additional coiled tubing downhole to move the jointed tubing deeper downhole; retracting (running-out) the coiled tubing to move the jointed tubing upward; pumping fluid through the downhole tool string to frac at a new depth; attaching jointed tubing to a bottom hole assembly having a check valve; remotely activating the check valve to close the bore at the bottom of the downhole tool string; and/or pressure testing the check valve to ensure it is closed and holding. In another embodiment, the method could also include retracting the tool string to locate the pressure-activated valve tool between two BOPs (Blowout Preventers); isolating the space between the two BOPs; pressurizing the space between the two BOPs in order to (actuate the pressure activated-valve tool to) close the valve; and bleeding off pressure/fluid from the tool string above closed valve. An alternative embodiment could comprise retracting the tool string to locate the pressure-activated valve tool above a BOP (outside the well); and manually activating/closing the valve. Another embodiment could comprise using an isolated space between two stripper packers, instead of an isolated space between two BOP. Another embodiment could comprise activating the valve remotely downhole (with the embodiment of the valve tool having a burst disk operable to rupture at a designated pressure) by pressurizing the annular space of the well sufficiently to rupture the burst disk, thereby allowing the annular pressure to actuate the pressure-activated valve tool (typically by flowing through a port previously sealed by the burst disk and into a chamber having two seals with differential area). Embodiments of the method could also include the steps of breaking up the string (by disconnecting the coiled tubing from the tool; reducing pressure between BOPs to open a valve; and dropping a plug through the hybrid tool string to seal a bottom hole assembly, for example).

In another aspect, the disclosure includes a method of bringing up a downhole tool string with coiled tubing disposed above a pressure-activated valve, which is disposed above jointed tubing, comprising: retracting the tool string to dispose the pressure-activated valve between two blowout preventers (or stripper packers) in the well (or within an isolated section of the well); and increasing the pressure between the two blowout preventers (within the isolated section) to a level sufficient to activate the pressure-activated valve. In an embodiment, the method further comprises isolating the area between the two blowout preventers so that pumping fluid between the two BOPs will increase pressure; wherein increasing the pressure between the two BOPs comprises pumping fluid into the isolated area between the two BOPs. In another embodiment, the method further comprises bleeding off fluid pressure in the tool string above the pressure-activated valve. In yet another embodiment, the method further comprises dropping a plug through the pressure-activated valve to seal a bottom hole assembly disposed at the bottom of the jointed tubing. In an embodiment, dropping a plug further comprises pressurizing the tool string to a level sufficient to open the pressure-activated valve, and the bottom hole assembly comprises a seat with a profile and the plug comprises a profile that matches/mates with that of the bottom hole assembly seat. In an alternative embodiment, dropping a plug further comprises decreasing the pressure between the two blowout preventers to open the pressure-activated valve. Optionally, the plug may be a wireline plug or a ball plug. Embodiments of the method may further comprise breaking up the tool string, with breaking up the tool string further comprising disconnecting the coiled tubing from the pressure-activated valve, disconnecting the pressure-activated valve from the jointed tubing, and disconnecting the jointed tubing segment by segment. In another embodiment, the pressure-activated valve may be placed downhole below the jointed tubing as part of the jetting/fracturing/downhole operation assembly, and remotely activated downhole. This would avoid the need to use any sort of special wireline or slickline plug to isolate the tubing at the bottom of the string. Also, in an embodiment, more than one pressure-activated valve tool can be used in a hybrid string, with the tool(s) being located anywhere along the length of the string.

In another aspect, the disclosure includes a method of bringing up a downhole tool string with coiled tubing disposed above a pressure-activated valve tool, which is disposed above jointed tubing, comprising: retracting the tool string to dispose the pressure-activated valve above a BOP (or to withdraw the pressure-activated valve tool from the well); and manually activating the pressure-activated valve tool (to close it). In an embodiment of this aspect, manually activating the pressure-activated valve comprises attaching a fluid line to the pressure-activated valve; and pumping fluid though the line to increase the pressure on the pressure-activated valve to a level sufficient to activate the pressure-activated valve (to close the valve).

In another aspect, the disclosure includes a tool for use in a downhole tool string with coiled tubing and jointed tubing, comprising: a housing adapted to be made up as part of the tool string and having a longitudinal bore therethrough; a pressure-activated valve mounted within the housing to control fluid flow through the longitudinal bore, having an open position allowing fluid flow through the bore and a closed position blocking fluid flow through the bore; a port in (penetrating through) the housing allowing application of pressure to the pressure-activated valve; wherein: in the absence of sufficient pressure, the pressure-activated valve is open; and the pressure-activated valve is operable to be closed by application of sufficient pressure via the port.

In another aspect, the disclosure includes a tool for use in a downhole tool string with coiled tubing and jointed tubing, comprising: a housing adapted to be made up as part of the tool string and having a longitudinal bore therethrough; a flapper mounted within the housing to control fluid flow through the longitudinal bore, having an open position allowing fluid flow through the bore and a closed position blocking fluid flow through the bore (to seal the bore); a sleeve slidably disposed for longitudinal movement within the housing between a first (lower) and a second (upper) position, such that when the sleeve is located in the first position, the flapper is in the open position, and when the sleeve is located in the second position, the flapper is operable to close (into the closed position); an upper and a lower seal between (the outer surface of) the sleeve and (the inner surface of) the housing which together isolate an annular space between the sleeve and the housing; a port in (penetrating through) the housing leading to (providing access to/providing fluid communication with/allowing injection of fluid into) the annular space; wherein: the upper seal has a greater surface area than does the lower seal; and the flapper is biased towards the closed position. In one embodiment of this aspect, the tool may further comprise a means to connect a first end of the housing to coiled tubing and a means to connect a second end of the housing to jointed tubing. The means to connect to coiled tubing may comprise a splined quick-connector and a double slip coiled tubing connector. In another embodiment, the flapper is shielded from wear when located in the open position by the sleeve located in the first position. In yet another embodiment, the tool further comprises one or more shear pins/screws which fix the sleeve in the first position and which are capable of being sheared to release the sleeve if pressure in the annular space rises above a set point (which is greater than the highest pressure typically encountered in normal downhole operation). In an alternative embodiment, the tool further comprises one or more springs biasing the sleeve towards the first position. In another embodiment, pressure in the annular space results in an upward force, pushing the sleeve from the first position towards the second position, due to the difference in the surface area of the upper and lower seals. So one or more embodiments may allow the flapper to be remotely opened or closed by (injecting fluid through the port into the annular space and) pressurizing the annular space (wherein pressure must be sufficiently high to either shear the shear pins or overcome the one or more springs).

In yet another aspect, the disclosure includes a tool for use in a downhole tool string with coiled tubing and jointed tubing, comprising: a housing adapted to be made up as part of the tool string and having a longitudinal bore therethrough; a flapper mounted within the housing to control fluid flow through the longitudinal bore, having an open position allowing fluid flow through the bore and a closed position blocking fluid flow through the bore (to seal the bore); a sleeve slidably disposed for longitudinal movement within the housing between a first (lower) and a second (upper) position, such that when the sleeve is located in the first position, the flapper is in the open position, and when the sleeve is located in the second position, the flapper is operable to close (into the closed position); a middle seal and a lower seal between (the outer surface of) the sleeve and (the inner surface of) the housing which together isolate a first annular space (lower chamber) between the sleeve and the housing; a first port in (penetrating through) the housing leading to (providing access to/providing fluid communication with/allowing injection of fluid into) the first annular space; a first bleed plug/port in the housing operable to allow venting of the first annular space (lower chamber); an upper seal which, together with the middle seal, isolates a second annular space (upper chamber) between the sleeve and the housing; a second port in the housing leading to the second annular space; a second bleed plug/port in the housing operable to allow venting of the second annular space (upper chamber); and one or more springs biasing the sleeve towards the first position; wherein the middle seal has a greater surface area than does the lower seal or the upper seal; and the flapper is biased towards the closed position. In one embodiment, the pressure in the first annular space results in an upward force, pushing the sleeve from the first position towards the second position, due to the difference in the surface area of the middle and lower seals. In another embodiment, the flapper may be remotely opened or closed by (injecting fluid through the port into the annular space and) pressurizing the first annular space. In yet another embodiment, the first port may comprise a check valve, and/or the first port may be removably sealed by a burst disc (allowing for activation of the valve by increasing the pressure to burst the disc anywhere along the depth of the well). And in still another embodiment, the first and second annular space may contain an incompressible fluid.

In another aspect, the disclosure includes a tool for use in a downhole tool string with coiled tubing and jointed tubing, comprising: a housing adapted to be made up as part of the tool string and having a longitudinal bore therethrough; a pressure-activated valve mounted within the housing to control fluid flow through the longitudinal bore, having an open position allowing fluid flow through the bore and a closed position blocking fluid flow through the bore; a port in (penetrating through) the housing allowing application of pressure to the pressure-activated valve; wherein: the pressure-activated valve comprises a lower chamber accessible via the port which is operable to close the pressure-activated valve by application of sufficient pressure via the port; and the pressure-activated valve further comprises an upper chamber having one or more forces biasing the pressure-activated valve towards its open position, such that in the absence of sufficient pressure on the port (of the lower chamber), the pressure-activated valve is open. In some embodiments, the pressure-activated valve further comprises: a sleeve slidably disposed for longitudinal movement within the housing between a first (lower) and a second (upper) position, such that when the sleeve is located in the first position, the flapper is in the open position, and when the sleeve is located in the second position, the flapper is operable to close (into the closed position); and an upper, middle, and lower seal; wherein the upper chamber comprises the upper seal and the middle seal, and the lower chamber comprises the middle seal and the lower seal; and wherein the middle seal has a greater sealing diameter than either the upper or lower seal. The port may also comprise a check valve. Also, the upper chamber may comprise one or more springs biasing the sleeve towards its first position. Alternatively, the upper chamber may comprise a second port in the housing allowing application of pressure to the upper chamber, and wherein the upper chamber may be biased towards its open position by application of sufficient pressure via the second port (either alone or in addition to the spring force).

In another aspect, the disclosure includes a method of operating a hybrid tool string in a well, comprising the steps of: forming up jointed tubing; attaching a pressure-activated valve tool having an upper and a lower chamber atop jointed tubing; attaching coiled tubing atop the pressure-activated valve tool; filling the upper and lower chamber with a fluid; and unspooling/injecting coiled tubing downhole to move the jointed tubing to desired downhole depth. In some embodiments, the pressure-activated valve tool may further comprise a port allowing application of pressure to the lower chamber, with the port removably sealed by a burst disc; the method further comprising the step of applying sufficient pressure to break the burst disc, thereby closing the pressure-activated valve. The use of a burst disc may allow for remote activation of the pressure-activated valve tool downhole (anywhere along the depth of the well). In some embodiments, the upper chamber of the pressure-activated valve tool may comprise a bleed port for venting incompressible fluid out of the upper chamber. In other embodiment, the pressure-activated valve tool may be activated near the surface between two BOP or stripper packers. Typically in such cases, the fluid is an incompressible fluid, and the pressure-activated valve tool further comprises a port allowing application of pressure to the lower chamber. Then, the method may include retracting the tool string to dispose the port of the lower chamber of the pressure-activated valve tool in a section of the well capable of being isolated (typically between two blow-out preventers); isolating the section of the well to allow for pressurization of the section; and pressurizing the lower chamber to activate (close) the pressure-activated valve tool. In some embodiments, the upper chamber may comprise a bleed port for venting fluid out of the upper chamber and/or an inlet port allowing application of pressure to the upper chamber (in which case the upper chamber may be pressurized in some instances to reopen the pressure-activated valve tool). The lower chamber may further comprise a second bleed port for venting fluid out of the lower chamber (so that fluid may be vented out of the lower chamber to reduce the pressure within the lower chamber (thereby reopening the pressure-activated valve)). Venting the lower chamber may be done in conjunction with pressurizing the upper chamber as well, to further assist in re-opening the valve.

In another aspect, the disclosure includes a downhole tool string comprising: coiled tubing; jointed tubing; and a pressure-activated valve tool disposed between the coiled tubing and the jointed tubing. Alternatively, the pressure-activated valve tool may be located anywhere along the length of the tool string (including the bottom hole assembly). The pressure-activated valve tool may further comprise any of the aspects or embodiments described above, and may be connected in series between the coiled tubing and the jointed tubing. Further, the hybrid downhole tool string may be used in any of the method aspects and embodiments described above.

BRIEF DESCRIPTION OF THE DRAWINGS

For a more complete understanding of the present disclosure, and for further details and advantages thereof, reference is now made to the accompanying drawings, in which.

DETAILED DESCRIPTION

Coiled tubing and jointed tubing tend to have different characteristics. By way of example, jointed tubing typically is higher strength, making it better adapted to operate deep in the bottom of a well hole. Also by way of example, coiled tubing is a continuous string that can be tripped in and out of hole without needing to make connections, whereas jointed tubing is snubbed piecewise according to length of each joint. Thus, coiled tubing typically is quicker and easier to move up or downhole in the well. To take advantage of these differing characteristics, the hybrid tool string described herein generally has jointed tubing located towards the bottom of the tool string, with coiled tubing located above it, towards the top of the tool string (although any combination of coiled and jointed tubing could be used in the hybrid tool string). This configuration allows for the jointed tubing to be moved up and down hole using the coiled tubing (which can be unspooled to insert or re-spooled to retract the tool string), allowing for quick repositioning of the jointed tubing at different depths downhole in the well. Disclosed embodiments of the hybrid tool string also generally include a means to seal (typically pressure activated) the fluid flowpath within the tubing string in proximity to the connection between the coiled tubing and the jointed tubing. Such a sealing means would allow isolation of the well pressure at the point of connection that may facilitate disconnection of the coiled tubing from the jointed tubing. Disclosed embodiments of the hybrid tool string may employ a pressure-activated valve located in between the coiled tubing and the jointed tubing as this sealing means. This pressure-activated valve would provide a means to seal the bore (and thus the fluid flowpath) of the tubing string, and the seal may be activated using pressure. Disclosed embodiments of the hybrid tool string would typically be used with a hydraulic workover rig, to aid in performance of well workover (although other uses may also be contemplated).

Figure 1A:
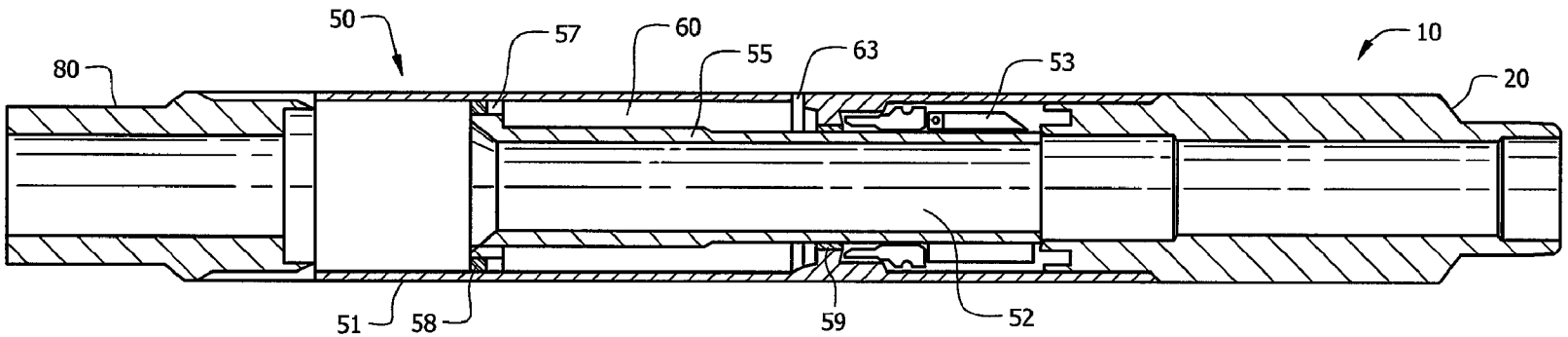
FIG. 1A is a sectional view of an embodiment of a hybrid downhole tool string with an open bore.
Figure 1B:
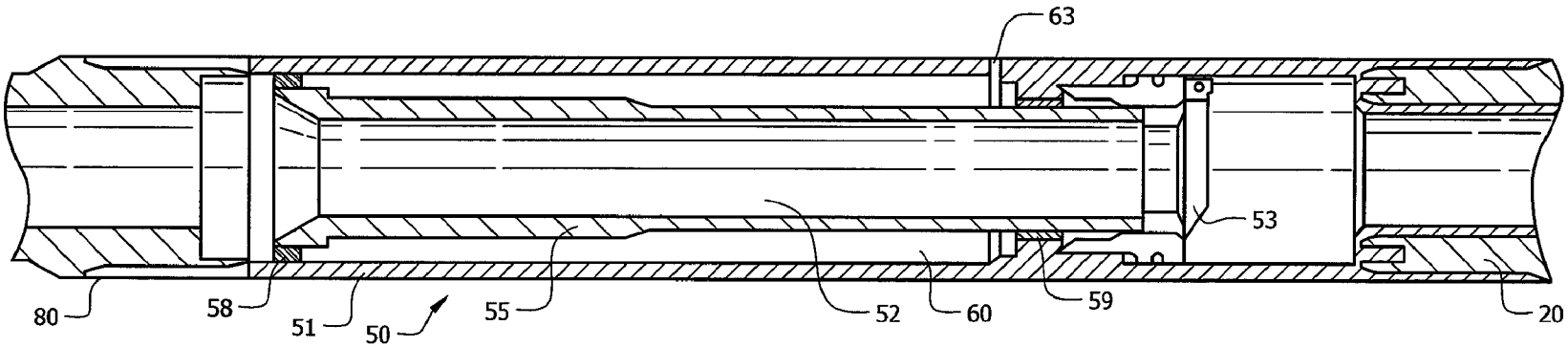
FIG. 1B is a sectional view of the hybrid tool string of FIG. 1A with a closed valve sealing the bore.
Figure 3:
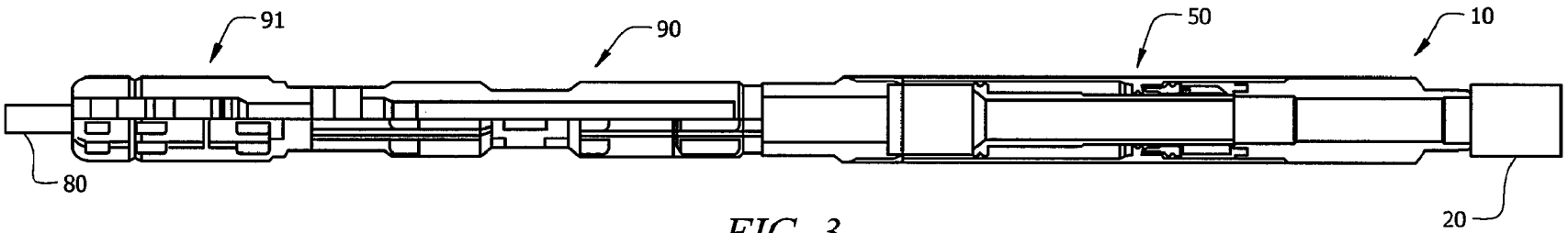
FIG. 3 is a sectional view of another embodiment of the hybrid tool string with connector elements between the pressure-activated valve tool and the coiled tubing.

FIG. 3 illustrates an embodiment of the hybrid tool string 10, in which jointed tubing 20 is attached to a pressure-activated valve tool 50, which is in turn attached to coiled tubing 80. FIGS. 1A and 1B illustrate one embodiment of the pressure-activated valve tool 50. In FIG. 1A the pressure-activated valve 50 is shown in the open position (such that there is a complete and uninterrupted fluid flowpath through the bore of the hybrid tool string 10), while in FIG. 1B the pressure-activated valve 50 is shown in the closed position (sealing the fluid flowpath in proximity to the connection between the coiled tubing and the jointed tubing). Thus, in FIG. 1A, the pressure-activated valve tool 50 is located at the connection between the coiled tubing 80 and the jointed tubing 20. Alternatively, in other embodiments the pressure-activated valve tool 50 may be located anywhere along the length of a tool string (at any location where it might be desirable to be able to close the fluid flowpath). The pressure activated valve tool 50 shown in the embodiment of FIG. 1A has a housing 51 which may be adapted to be made up as part of the tool string 10, such that the housing 51 in FIG. 1A is configured to allow for attachment to jointed tubing 20 on one end and coiled tubing 80 at the other end (to form a continuous fluid flowpath through the bore of the tool string). The attachment to coiled tubing, the attachment to jointed tubing, or both may include adaptors, connectors, collars, joints, threading, or other structural make-up elements for connecting the valve body (e.g., housing 51) with the coiled tubing and/or jointed tubing. The housing 51, and thus the pressure-activated valve tool 50) has a longitudinal bore 52 running its entire length (which forms part of the continuous fluid flowpath through the tool string shown in FIG. 3).

Located within the housing 51 is a valve or other means to close or seal the longitudinal bore 52 through the pressure-activated valve tool 50. In FIG. 1A, the valve is a flapper 53 mounted within the housing 51 to control fluid flow through the longitudinal bore 52. The flapper 53 has an open position allowing fluid flow through the longitudinal bore 52 and a closed position blocking fluid flow through the longitudinal bore 52. The flapper 53 is shown in the open position in FIG. 1A, and is shown in its closed position in FIG. 1B. In FIG. 1A, the flapper 53 is biased towards the closed position (using a spring, for example). In an embodiment of the pressure-activated valve tool, the flapper may optionally have a concave contour in its face.

Also located within the housing 51 is a sleeve element that interacts with the flapper 53. The position of the sleeve determines whether the flapper 53 is open or whether the flapper 53 may be closed. The embodiment shown in FIG. 1A has a sleeve 55 that is slidably disposed for longitudinal movement within the housing 51 between a first (lower) position and a second (upper) position. The sleeve 55 is shown in its first position in FIG. 1A, and is shown in its second position in FIG. 1B. When the sleeve 55 is located in the first position, the sleeve 55 holds the flapper 53 in its open position, and when the sleeve 55 is located in the second position, the flapper 53 is operable to close (since the sleeve 55 is not located in a position to interfere with closing of the flapper by holding the flapper open). There is sufficient space in the housing 51 to provide the longitudinal play for the sleeve 55 to move between the first and second positions. In the embodiment of FIG. 1A, the sleeve 55 is held rigidly in the first position by one or more shear pins or screws 57, which are capable of being sheared to release the sleeve 55 if they experience sufficient pressure/force (typically an amount greater than the highest pressure usually encountered in normal downhole operation). As used throughout this application, the term "shear pins" includes shear screws and any other element that may rigidly fix the position of the sleeve and which is capable of being released by application of sufficient pressure. When the sleeve 55 in FIG. 1A is in the first position (holding the flapper 53 open so that the fluid flowpath through the longitudinal bore 52 is open), the sleeve 55 shields the flapper 53 from the fluid flowpath, thereby preventing or reducing wear (such as erosion or corrosion) on the flapper 53.

An upper seal 58 and a lower seal 59 are located between the outer surface of the sleeve 55 and the inner surface of the housing 51. These seals serve to isolate a section of annular space 60 between the inner sleeve 55 and the housing 51, preventing fluid flow across the seal in order to define a pressure sealed annular space 60. In FIG. 1A, the surface area of the upper seal 58 is greater than the surface area of the lower seal 59, as defined by a difference in sleeve and/or seal diameter at the location of the seals. A port 63, located in the housing 51 and penetrating through the housing 51, provides a fluid channel from outside the housing to the annular space 60. This port 63 provides access and allows fluid communication to the annular space 60 from outside of the housing 51 (thereby allowing for injection of fluid into the annular space 60 from outside of the housing). And in FIG. 1A, there is an optional plug or cap 65 on the port 63 which serves to seal the port 63 (such that there can be no fluid communication between the annular space 60 and the area outside the housing while the cap 65 is in place). This cap 65 may be configured to be removable, for example threaded. Alternatively, the cap 65 could be a burst disc (in which case, the cap 65 would seal the port 63 until it experiences a sufficiently high pressure to burst the cap 65, thereby removing the cap's seal on the port 63) or could be replaced by a one-way check valve.

So in the embodiment of FIG. 1A, the sleeve 55 would initially be held securely in its first (lower) position by the shear pins 57, such that the flapper 53 would be held open and shielded from the flow flowpath by the inner sleeve 55. In this open position, the pressure-activated valve tool 50 would provide a continuous fluid flowpath through the hybrid tool string (allowing fluid to move upward through the jointed tubing 20, through the pressure-activated valve tool 50, and into the coiled tubing 80 or vice versa (downward from the coiled tubing, through the pressure-activated valve tool, and into the jointed tubing). The flapper 53 of the pressure activated valve tool 50 in FIG. 1A would be capable of being closed by application of sufficient pressure into the annular space 60 through the port 63 (once the cap is either removed or burst, for example). If sufficient fluid is injected in to the annular space 60 via the port 63 to raise the pressure in the annular space 60 to the level necessary to shear the shear pins 57, then the sleeve 55 would be operable to slide upward to its second position (shown in FIG. 1B). In the embodiment in FIG. 1B, the sleeve 55 would be driven upward by the pressure in the annular space 60; the pressure in the annular space 60 would result in an upward force, pushing the sleeve 55 from its first position to its second position, due to the difference in the surface area of the upper and lower seals 58, 59 (i.e. the differential area of the seals would result in a net upward force on the sleeve). As the sleeve 55 retracts upward (into its second position shown in FIG. 1B), it is no longer in position to hold the flapper 53 open. The flapper 53 is biased towards the closed position, and so it will close (as shown in FIG. 1B) once it is no longer being held open. Thus, the flapper 53 in FIG. 1A may be remotely closed by pressurizing the annular space 60 sufficiently to shear the shear pins 58, 59 holding the sleeve 55 in its first position and to then exert an upward force (due to the greater surface area of the upper seal) on the sleeve 55 sufficient to move the sleeve 55 from its first position (shown in FIG. 1A) to its second position (shown in FIG. 1B).

While the valve shown in FIG. 1A is a flapper valve, other valves or means capable of sealing the fluid flowpath of the bore could alternatively be used. Examples of other such valves might include a ball valve, a poppet type valve, any combination of such valves, or any other valve that can restrict the flow of fluid through the bore of the tool string.

Figure 2A:
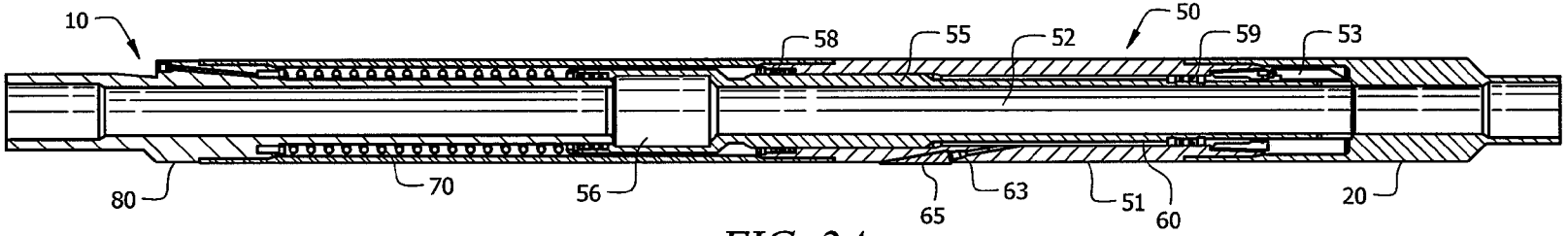
FIG. 2A is a sectional view of another embodiment of a hybrid downhole tool string with an open bore.
Figure 2B:
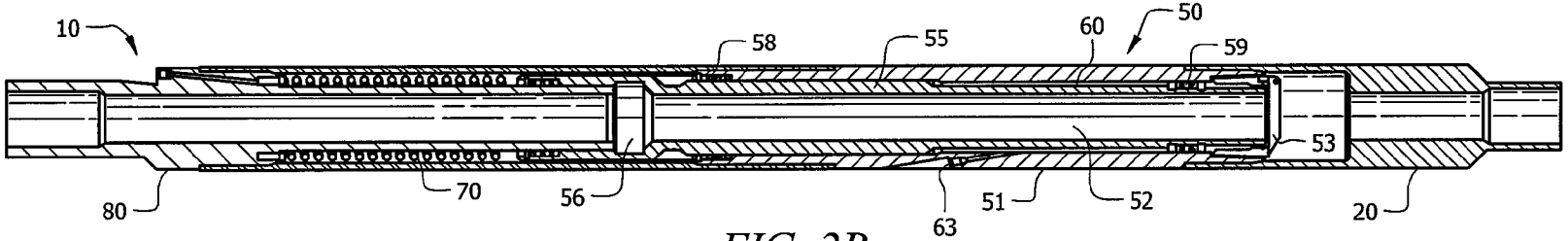
FIG. 2B is a sectional view of the hybrid tool string of FIG. 2A with a closed valve sealing the bore.

FIGS. 2A and 2B illustrate another embodiment of the hybrid tool string, and are similar to FIGS. 1A and 1B described above except that FIG. 2A does not use a plurality of shear pins as the means to removably/retractably hold the inner sleeve 55 in its first position. Instead, FIG. 2A biases the sleeve 55 downward towards its first position. In the embodiment shown in FIG. 2A, this is accomplished by one or more springs 70 operable to exert a downward force on the sleeve 55. Thus, in FIG. 2A, the springs 70 bias the sleeve 55 to its first position, thereby holding the flapper 53 open. In the embodiment in FIG. 2A, the springs 70 are sufficiently strong to overcome the biased flapper 53. The flapper 53 in FIG. 2A could be closed by pressurizing the annular space 60 sufficiently to overcome the spring 70 (perhaps in conjunction with the biased flapper). The pressure in the annular space 60 would force the sleeve 55 upward into its second position, allowing the biased flapper 53 to close (as shown in FIG. 2B).

FIG. 3 illustrates an embodiment of the hybrid tool string in which a particular means to attach the first (upper) end of the housing of the pressure-activated valve tool to the coiled tubing is shown. In FIG. 3, a splined quick-connect element 90 is first attached to the upper end of the pressure-activated valve tool 50. Then, a double slip coiled tubing connector 91 is attached to the splined quick-connect element 90, and the coiled tubing 80 is attached to this double slip coiled tubing connector 91. Attaching the coiled tubing 80 to the pressure-activated valve tool 50 in this manner allows for quick and easy connection and disconnection of the coiled tubing 80 in place in the hybrid tool string 10. The splined quick-connect element 90 typically requires no rotation for assembling tools to the coiled tubing. It also often has a higher torque rating and allows a large bore for high flow. In an embodiment, the splined quick-connect element 90 comprises a male splined top sub and a bottom sub. The bottom sub can be attached to the pressure-activated valve tool (typically at the upper end of the housing). The male splined top sub may then be inserted into the bottom sub, engaging splines. Then the make-up nut may be tightened to the bottom sub, completing the connection. The double slip connector is typically different from a regular service connector in that it has two ferrule lock rings instead of one, and no thread on the coiled tubing itself. In one embodiment, the double slip connector typically comprises a nut, lock rings, center sub and bottom sub. The nut and lock rings may first be inserted on the coiled tubing, followed by the center sub. The lock ring has jaws that bite on the coiled tubing, and it may then be held in place with the nut. The center sub may then be slid under the nut-lock ring assembly and secured in place with set screw. A second lock ring may be used in combination with bottom sub to complete the connection. The means to connect the bottom of the housing of the pressure-activated valve tool to the jointed tubing in the embodiment of FIG. 3 may be a threaded joint or other direct or indirect connection.

In operation, the hybrid tool string may be formed up and inserted (run-in) downhole. Jointed tubing is typically first formed up. Typically this includes joining tubing segments to form a sufficient length of jointed tubing. In some embodiments, a bottom hole assembly is attached to the bottom of the jointed tubing (with jointed tubing being assembled above the bottom hole assembly). Such a bottom hole assembly may (or alternatively may not) have a check, ball, or poppet valve operable to close/seal the bottom of the bore of the jointed tubing. Such valves may be part of the bottom hole assembly in situations where reverse flow is not required. Typically, jointed tubing is set in a rotary table and formed up in the well, such that the jointed tubing proceeds downward as it is formed. Once the jointed tubing has been formed, the pressure-activated valve tool is attached atop the jointed tubing. Any pressure-activated means to seal the bore could be used in series with the coiled and jointed tubing, and specific examples include the pressure-activated valve tools shown in FIGS. 1A and 2A. Then the coiled tubing is attached atop the pressure-activated valve tool. As shown in FIG. 3, the coiled tubing may be attached to the pressure-activated valve tool using a combination of a splined quick-connect element and a double slip coiled tubing connector. These connections provide an easy means of connecting the assembly of the hybrid tool string. Alternatively, the safety valve could be connected directly to the coiled tubing above it and to the jointed tubing below it using any of the following techniques: threaded, crimped, internal/external slips, grub screws, ball grab, jaw type, welded, bonded, chemically fused, and other commercially available means of joining.

The coiled tubing is typically stored on a spool and runs through an injector operable to push or pull the coiled tubing in and out of the well hole. So once the coiled tubing is attached atop the pressure-activated valve tool (to form the hybrid tool string), the injector injects coiled tubing downhole to move the jointed tubing to the desired downhole depth. To do so, the injector head typically pushes the coiled tubing through a stripper with pack-off elements providing a seal around the tubing to isolate the well's pressure, through one or more blowout preventers (typically in an BOP stack and having at least two strip packers), through the Christmas tree and into the well hole. More than one strip packer may also be run below the injector for redundant safety, and to be able to make/break connections between the two strip packers. Sufficient length of coiled tubing is injected into the well so that the jointed tubing reaches the desired depth downhole. Upon reaching depth, fluid may be pumped downhole through the hybrid tool string and circulated and/or pumped into the formation. The fluid may be abrasive, corrosive, and/or erosive (and perhaps containing solids, such as sand). In one embodiment, the fluid is fracturing fluid, for example a fracturing fluid comprising a proppant such as sand.

If desired, the jointed tubing may be repositioned in the well by either injecting more coiled tubing (to move the jointed tubing further downhole to greater depth) or retracting coiled tubing (to move the jointed tubing upward in the well). Once the jointed tubing is repositioned, fluid may once again be pumped downhole through the hybrid tool string (perhaps to fracture the well at the new depth). Well fracturing is only an exemplary use of the hybrid tool string; the hybrid tool string could be used for other well workover procedures, including well clean-out, well stimulation, drilling side tracks, setting packers, completion strings, etc.

Upon completion of the downhole job, the hybrid tool string may be withdrawn (pulled out of hole). Optionally, if a bottom hole assembly with a check valve is attached to the bottom of the jointed tubing, the check valve in the bottom hole assembly may be remotely activated to seal the bore at the bottom of the hybrid tool string. Pressure tests may also optionally be performed to ensure that the check valve is closed (sealing the bore) and that the seal is holding. This may be a concern, since the check valve in the bottom hole assembly often experiences high wear that may degrade its sealing capabilities (e.g., wear/abrasion from pumping particle laden fluids into the wellbore).

Figure 4:
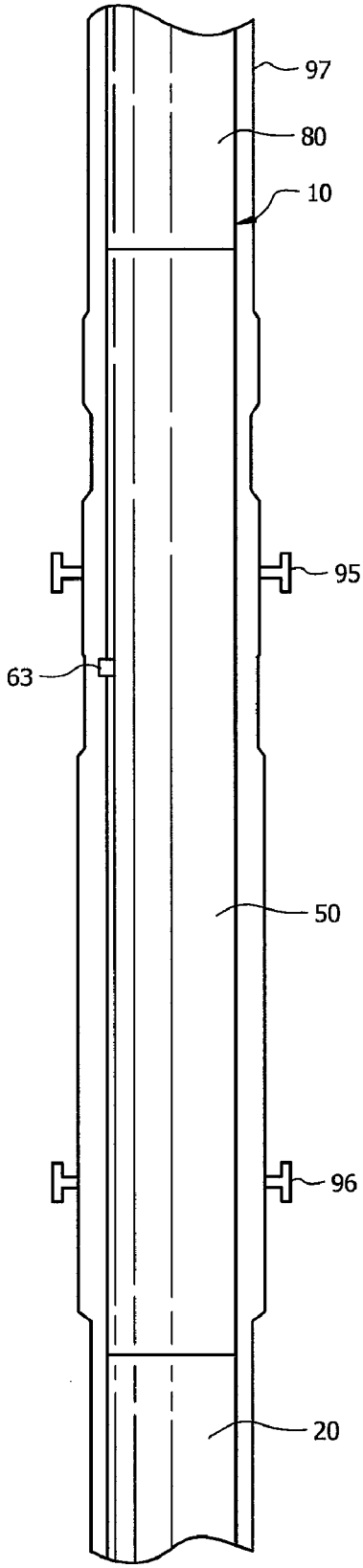
FIG. 4 is a diagram showing a pressure-activated valve tool of a hybrid tool string located within a well, with the pressure-activated valve tool located between two blowout preventers.

To withdraw the hybrid tool string, the coiled tubing can be retracted (so that it is re-spooled), drawing the pressure-activated tool and the jointed tubing upward. In one embodiment, illustrated in FIG. 4, the hybrid tool string 10 is retracted to locate the pressure-activated valve tool 50 in an isolated section of the well (capable of being pressurized). Techniques to isolate a section of the well (by for example sealing the annular space in at least two locations) may include the use of two blowout preventers 95, 96, two strip packers, two stripping rams, and/or two pipe rams. So for example, in the embodiment of FIG. 4, the pressure-activated valve tool 50 may be located between two blowout preventers 95, 96 (or alternatively, between two strip packers in the BOP stack), typically located above the wellhead. So for example, in the embodiment shown in FIG. 4, the upper seal and the lower seal of the pressure-activated valve tool would be located between the two blowout preventers. In an alternative embodiment, the port 63 of the pressure-activated valve tool would be located between the two blowout preventers. The two blowout preventers would then be used to isolate the space/section in the well 97 between the two blowout preventers, effectively forming a top seal and a bottom seal around the hybrid tool string (and allowing pressurization and/or depressurization of the isolated section of the well between the blowout preventers). The space between the two blowout preventers would then be pressurized (typically by flowing fluid into the pressure-sealed space between the two blowout preventers, and thereby into the port and the annular space in the pressure-activated valve tool) to a sufficient level to actuate the pressure-activated valve tool, closing the valve to seal the fluid flowpath of the bore of the hybrid tool string. If a burst disc is covering port 63, sufficient pressure may be applied to rupture the burst disc and allow the flow of fluid though port 63. So this technique may be used to remotely seal the fluid flowpath of the hybrid tool string by positioning the connection of the coiled tubing to the jointed tubing (typically a pressure-activated valve tool in the embodiments shown in FIG. 1A) within a section of the well capable of being isolated (shown as a space or section between two blowout preventers in FIG. 3), and then pressurizing the isolated section of the well to activate a seal across the fluid flowpath.

In the embodiment shown in FIGS. 1A and 1B, the space between the two blowout preventers is pressurized to a level sufficient to shear the shear pins (as the fluid used to pressurize the space flows through the port into the annular space), and then the inner sleeve is pushed upward due to the force exerted by the pressure on the larger surface area of the upper seal. Once the inner sleeve moves upward into the second position, the biased flapper closes. In this way, the pressure-activated valve tool may be remotely activated (to seal the fluid flowpath of the hybrid tool string) by pressurizing the isolated space between the two blowout preventers. Similarly, in the embodiment of FIGS. 2A and 2B, the space/section between the two blowout preventers is pressurized to a level sufficient to overcome the spring(s) biasing the inner sleeve downward into its first position. As the inner sleeve is pushed upward (due to the force resulting from the difference between the pressure acting on the larger surface area of the upper seal compared to the pressure acting on the smaller surface of the lower seal) into its second position, the biased flapper may close.

Alternatively, the pressure-activated valve tool of the hybrid tool string can be operated manually by retracting the tool string out of the well (to a point above the blowout preventer) to a point where the port is accessible, attaching a fluid line to the port, and pumping fluid through the line to increase the pressure experienced by the pressure-activated valve tool to a level sufficient to activate the valve. Once the pressure in the annular space of the pressure-activated tool of FIG. 1A or 2A reaches a sufficient level, the valve will close to seal the bore (as shown in FIGS. 1B and 2B). The cap over the pressurization port may be manually removed in this instance, allowing access to the port.

Once the pressure-activated valve tool has been closed (sealing off the fluid flowpath in the bore of the hybrid tool string), the fluid pressure in the tool string above the pressure-activated valve may be bled off. A plug may be dropped through the pressure-activated valve to seal the bottom hole assembly (with the plug typically being either launched via gravity or pressure or placed via wireline). Such a plug would typically have a profile that matches a corresponding seating on the bottom hole assembly, so that the plug can effectively seal the bottom hole assembly in order to seal the bottom of the hybrid tool string, which in turn allows for the fluid pressure in the hybrid tool string (and particularly the pressure in the jointed tubing below the pressure-activated valve to be bled off). When dropping a plug, the pressure activated valve may be opened either by releasing the pressure used to activate the valve (in the case of a pressure-activated valve with a spring biasing the inner sleeve downward towards the first position), and/or by pressurizing the hybrid tool string (in its longitudinal bore) sufficiently to force the valve to open (with pressure sufficient to overcome the biased flapper, for example).

The hybrid tool string may then be broken up, with the connection between the coiled tubing and the pressure-activated valve tool and the connection between the pressure-activated valve tool and the jointed tubing being broken, and the jointed tubing being disassembled using a workover procedure. The coiled tubing could be disconnected from the pressure-activated valve tool and could be re-spooled. The pressure-activated valve tool would be disconnected from the jointed tubing and removed. Finally, the jointed tubing segments would be broken up and disassembled, completing hydraulic workover of the well.

Figure 5A:
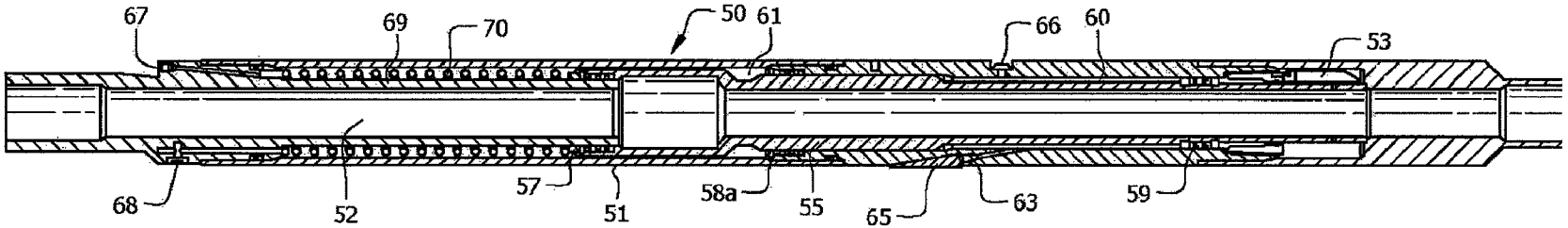
FIG. 5A is a sectional view of another embodiment of a pressure-activated valve tool with an open flapper valve.
Figure 5B:
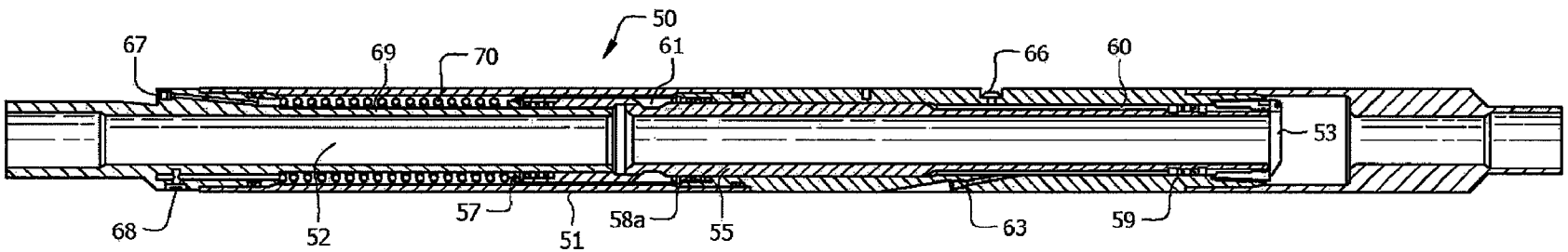
FIG. 5B is a sectional view of the pressure-activated valve tool of FIG. 5A with a closed flapper valve.

FIGS. 5A and 5B illustrate an alternative embodiment of a pressure-activated valve tool 50 (with FIG. 5A showing the tool in the open position, and FIG. 5B showing the tool in the closed position). The embodiment shown in FIG. 5A is similar to that of FIG. 2A, but rather than comprising a single fluid chamber (like the annular space 60 in FIG. 2A), FIG. 5A comprises two such chambers. More specifically, FIG. 5A comprises an upper chamber and a lower chamber, which may assist in opening and/or closing the pressure-activated valve. Such a design may provide for a pressure-activated valve tool 50 that can effectively be opened and/or closed more than once.

So In FIG. 5A, the pressure-activated valve tool 50 is shown in the open position (such that there is a complete and uninterrupted fluid flowpath through the bore of the hybrid tool string). The pressure-activated valve tool 50 of FIG. 5A has a housing 51 which may be adapted to be made up as part of the tool string (such that the housing 51 is configured to allow for attachment of jointed and/or coiled tubing at either end of the housing). The housing 51, and thus the pressure-activated valve tool 50, has a longitudinal bore 52 running its entire length (which forms part of the continuous fluid flowpath through the tool string).

Located in the housing 51 is a valve or other means to close or seal the longitudinal bore 52 through the pressure-activated valve tool 50. In FIG. 5, the valve is a flapper 53 mounted within the housing 51 to control fluid flow through the longitudinal bore 52. The flapper has an open position allowing fluid flow through the longitudinal bore 52 and a closed position blocking fluid flow through the longitudinal bore 52. The flapper 53 is shown in the open position in FIG. 5A and in the closed position in FIG. 5B. In FIG. 5A, the flapper is biased towards the closed position (typically using a small spring, for example).

Also located within the housing 51 of the embodiment shown in FIG. 5A is a sleeve element that interacts with the flapper 53. The position of the sleeve 55 determines whether the flapper 53 is open or whether the flapper 53 may be closed. The embodiment shown in FIG. 5A has a sleeve 55 that is slidably disposed for longitudinal movement within the housing 51 between a first (lower) position and a second (upper) position. The sleeve 55 is shown in its first position in FIG. 5A and in its second position in FIG. 5B. When the sleeve 55 is located in the first position, the sleeve 55 holds the flapper 53 in its open position, and when the sleeve 55 is located in the second position, the flapper 53 is operable to close (since the sleeve 55 is not located in a position to interfere with closing of the flapper). When the sleeve 55 of FIG. 5A is in the first position (holding the flapper 53 open so that the fluid flowpath through the longitudinal bore 52 is open), the sleeve 55 shields the flapper 53 from the fluid flowpath, thereby preventing or reducing wear on the flapper 53.

The embodiment of the pressure-activated valve tool 50 shown in FIG. 5A has three seals, which define an upper and a lower chamber. A middle seal 58*a* and a lower seal 59 are located (radially) between the outer surface of the sleeve 55 and the inner surface of the housing 51. The lower seal 59 is located longitudinally in proximity to the flapper 53 (so that in practice, it would typically be located slightly above the flapper), while the middle seal 58*a* is typically located longitudinally farther from the flapper (so that in practice, the middle seal would typically be located above the lower seal). The middle seal 58*a* and lower seal 59 serve to isolate a section of the annular space between the sleeve 55 and the housing 51, preventing fluid flow across the seal in order to define a pressure sealed annular space (i.e. a lower chamber 60). The lower chamber 60 has a port 63 located in the housing 51 and penetrating through the housing 51, providing a fluid channel (inlet) from outside the housing to the lower chamber 60. This port 63 provides access and allows fluid communication to the lower chamber 60 from outside of the housing 51 (thereby allowing for injection of fluid into the lower chamber 60 from outside of the housing). In FIG. 5A, the port 63 includes a one-way check valve configured to allow injection of fluid into the lower chamber 60, while preventing fluid flow out of the lower chamber 60 (through the inlet). This may be a Lee check valve, which may also have a filter. And in FIG. 5A, there is an optional cap or plug 65 on the port 63 which serves to seal the port 63 (such that there can be no fluid communication between the lower chamber 60 and the area outside the housing when the cap 65 is in place). This cap is typically configured to be removable (although alternatively, in some embodiments the cap may comprise a burst disc). In the embodiment of FIG. 5A, the lower chamber 60 also includes a bleed plug/port 66 located in the housing 51, which penetrates the housing 51 to provide a fluid channel (outlet) from the lower chamber 60 to the area outside of the housing. This bleed plug/port 66 has a removable plug. While the bleed plug 66 is in place in the housing, it seals the bleed port (preventing fluids from exiting the lower chamber via the outlet). Once the bleed plug is removed, however, fluid in the lower chamber may exit the bleed port (allowing fluid in the lower chamber to be evacuated to a lower pressure area outside the housing 51).

The upper chamber 61 of FIG. 5A is located above the lower chamber 60 (i.e. away from the flapper 53, typically upstream), and in FIG. 5A the upper chamber 61 comprises an upper seal 57 and the middle seal 58*a*. More specifically, in FIG. 5A the upper chamber is defined by at least the housing 51, the upper seal 57, and the middle seal 58*a*. Typically, the upper seal 57 is located radially between the sleeve 55 and the housing 51, and is located longitudinally upstream of the middle seal 58*a* (i.e. farther from the flapper 53). In the specific embodiment shown in FIG. 5A, the housing 51 includes an inner tube 69 (that projects out within the outer casing of the housing) that slidingly engages inside the sleeve 55 (such that the sleeve 55 is operable to slide longitudinally between the outer casing of the housing 51 and the inner tube 69 of the housing 51). In this configuration, the upper seal 57 is specifically located radially between the inner surface of the sleeve 55 and the outer surface of the inner tube 69 of the housing (such that, despite the fact that the sleeve 55 may slide with respect to the inner tube 69, fluid may not cross this boundary interface). So in FIG. 5A, the upper seal 57 and the middle seal 58*a* serve to isolate a section of the annular space between the sleeve 55 and the housing 51 (and more specifically between the sleeve 55, the inner tube 69, and the outer casing of the housing 51), preventing fluid flow across the seals in order to define a second pressure sealed annular space (i.e. an upper chamber 61). This configuration also provides space between the inner tube 69 and the outer casing of the housing 51 for one or more springs 70, which may bias the sleeve 55 downward towards its first (lower) position.

The upper chamber 61 has a port 67 located in the housing 51 and penetrating through the housing 51, providing a fluid channel (inlet) from outside the housing to the upper chamber 61. This port 67 provides access and allows fluid communication to the upper chamber 61 from outside of the housing 51 (thereby allowing for injection of fluid into the upper chamber 61 from outside of the housing). In FIG. 5A, the port 67 may include a one-way check valve configured to allow injection of fluid into the upper chamber 60, while preventing fluid flow out of the upper chamber 60. Alternatively, the one-way check valve could be configured for flow in the opposite direction. And in FIG. 5A, there may be an optional cap or plug on the port 67 which serves to seal the port 67 (such that there can be no fluid communication between the upper chamber 61 and the area outside the housing when the cap is in place). This cap is typically configured to be removable (although alternatively, in some embodiments the cap may comprise a burst disc). In the embodiment of FIG. 5A, the upper chamber 61 also includes a bleed plug/port 68 located in the housing 51, which penetrates the housing 51 to provide a fluid channel (outlet) from the upper chamber 61 to the area outside of the housing. This bleed plug/port 68 typically has a removable plug. While the bleed plug 68 is in place in the housing, it seals the bleed port (preventing fluids from exiting the upper chamber via the outlet). Once the bleed plug is removed, however, fluid in the upper chamber may exit through the bleed port (allowing fluid in the upper chamber to be evacuated to a lower pressure area outside the housing 51).

In the embodiment shown in FIG. 5A, the middle seal 58*a* has a greater surface area (sealing diameter) than that of the upper seal 57 or the lower seal 59 (and typically, the upper and lower seal may have equal surface areas). This type of configuration allows for the upper chamber and lower chamber to be used to assist in opening and closing the flapper valve 53. More specifically, in FIG. 5A the sleeve 55 would be driven upward by increasing pressure in the lower chamber 60 (with the increased pressure in the lower chamber 60 resulting in a net upward force due to the differential in area being acted upon by the pressure, pushing the sleeve 55 from its first position towards its second position). Similarly, the sleeve 55 could be driven downward by increasing the pressure in the upper chamber 61 (with the increased pressure in the upper chamber 61 resulting in an net downward force due to the differential surface area of the upper seal 57 and middle seal 58*a*, pushing the sleeve from its second position towards its first position). Thus, a pressure-activated valve tool 50 with both an upper and a lower chamber may allow for more control over the opening and closing of the flapper valve 53 (and may allow for multiple activation and/or deactivation of the valve).

Typically, the upper chamber 61 is operable to have one or more biasing forces directed to forcing the sleeve 55 downward into its first (lower) position. In FIG. 5A, the sleeve 55 is removably/retractably held in its first position by one or more springs 70 that bias the sleeve 55 downward towards its first position. More specifically, in FIG. 5A there are one or more springs located in the upper chamber 61 which are operable to exert a downward force on the sleeve 55, biasing the sleeve to its first position (and thereby holding the flapper 53 open). The one or more springs 70 are sufficiently strong to overcome the biased flapper 53. By way of example, the spring force plus seal friction could be approximately 1000 lbf or more in some embodiments. The flapper 53 in FIG. 5A could initially be closed by pressurizing the lower chamber 60 sufficiently to overcome the spring (perhaps in conjunction with the biased flapper). By way of example, a pressure of approximately 3000 psi might be sufficient to close the valve in some embodiments. The pressure in the lower chamber would force the sleeve 55 upward into its second position (compressing the spring 70 as shown in FIG. 5B), allowing the biased flapper 53 to close. The flapper 53 in FIG. 5B could then be reopened either by pressurizing the upper chamber 61 (to counteract the force generated by the pressurized lower chamber 60, thereby allowing the spring 70 to drive the sleeve 55 downward towards its first position) and/or by bleeding off the pressure from the lower chamber (via the bleed plug 66). And in alternative embodiments, pressurizing the upper chamber could be used in place of the spring 70. Either, or both, of these downward biasing forces could be used.

So in the embodiment of FIG. 5A, the sleeve 55 would initially be held securely in its first (lower) position by the spring 70, such that the flapper 53 would be held open and shielded from the flow flowpath by the inner sleeve 55. In this open position, the pressure-activated valve tool 50 would provide a continuous fluid flowpath through the hybrid tool string (allowing fluid to move upward through the jointed tubing 20, through the pressure-activated valve tool 50, and into the coiled tubing 80 or vice versa (downward from the coiled tubing, through the pressure-activated valve tool, and into the jointed tubing). The flapper 53 of the pressure activated valve tool 50 in FIG. 5A would be capable of being closed by application of sufficient pressure into the lower chamber 60 through the port 63 (once the cap is either removed or burst, for example). If sufficient fluid is injected into the lower chamber 60 via the port 63 to raise the pressure in the lower chamber 60 to the level necessary to overcome the force of the spring 70, then the sleeve 55 would be operable to slide upward to its second position. The sleeve 55 would be driven upward by the pressure in the lower chamber 60; the pressure in the lower chamber 60 would result in an upward force, pushing the sleeve 55 from its first position to its second position, due to the difference in the surface area of the middle and lower seals 58*a*, 59 (i.e. the differential area of the seals would result in a net upward force on the sleeve). As the sleeve 55 retracts upward (into its second position), it is no longer in position to hold the flapper 53 open. The flapper 53 is biased towards the closed position, and so it will close once it is no longer being held open. Thus, the flapper 53 in FIG. 5A may be remotely closed by pressurizing the lower chamber 60 sufficiently to exert an upward force (due to the greater surface area of the middle seal) on the sleeve 55 sufficient to overcome the spring 70 and to move the sleeve 55 from its first position to its second (closed) position.

Then, if it is desirable to reopen the pressure-activated valve 50, the upper chamber 61 of FIG. 5B could be pressurized to force the sleeve 55 downward. The upper chamber 61 could be pressurized (by injecting fluid via the inlet port 67) to a level sufficient to counteract the force applied on the sleeve by the lower chamber 60, thereby allowing the spring 70 to force the sleeve 55 downward towards its first position. In another alternative embodiment, the lower chamber 60 could have its pressure bled off (via the bleed plug), allowing the spring 70 to force the sleeve downward. Or in yet another embodiment, the pressure could be bled from the lower chamber 60 and the upper chamber could also be pressurized (either with or without a spring) to drive the sleeve downward towards its first position. By using a pressurized upper chamber 61 in conjunction with a spring 70 to reopen the flapper valve 53, the opening force can be increased. This may be useful if there is a large pressure gradient across the flapper valve (with a large pressure behind the flapper making opening difficult), and may also be useful to quickly open the flapper 53 to reduce wear. Also, by pressurizing the upper chamber in conjunction with the spring 70, accidental flapper closure may be avoided.

In practice, when the pressure-activated valve tool 50 of FIG. 5A is used in a tool string, the upper and lower chambers are often filled with fluid prior to run-in (insertion into the well). If the pressure-activated valve is intended to be activated between blowout preventers, then typically the upper and lower chamber would be filled with an incompressible fluid having a low coefficient of thermal expansion (while the flapper is in the open position). In one embodiment, the incompressible fluid would be silicone grease/oil. Filling the chambers with the silicone grease would ensure that there was no atmosphere in the chambers, improving safety. So typically, to fill a chamber with silicone grease, the bleed plug would be taken out, the cap would be removed (if necessary), and then silicone grease would be pumped into the chamber through the port with the one-way check valve until the fluid starts to come out the bleed plug/port. Then once the chamber has been filled, the bleed plug would be inserted to seal the chamber (and optionally, the cap could be inserted to close the inlet port).

The tool string would then be inserted downhole. Upon completion of downhole operations, the pressure-activated valve tool would be run back up to the surface (above the blowout preventers). The cap 65 could then be removed from the inlet port 63 on the lower chamber 60, and the bleed plug 68 could be removed from the bleed port in the upper chamber 61 in preparation of activation (closing) of the flapper valve 53. The pressure-activated valve tool 50 would then be positioned between two blowout preventers (or two other means of sealing the well space around the tool to isolate a section of the well) being used to isolate a section of the well, with the lower chamber 60 (and more specifically the inlet port 63) being located in the isolated space (between the blowout preventers) while the upper chamber 61 (and more specifically the port 67 and bleed plug/port 68 of the upper chamber) would be located above the isolated section of the well (which might be defined by blowout preventers), thereby experiencing atmospheric pressure. The bleed plug/port 68 of the upper chamber 61 could also be connected to a bleed line of sufficient volume to hold the silicone grease/oil from the upper chamber. So, fluid would be injected into the isolated section (between blowout preventers) so that only the lower chamber 60 would be pressurized (with fluid flowing into the lower chamber 60 through the one-way check valve in the port 63, pressurizing the lower chamber sufficiently to push the sleeve 55 upward towards its second position, thereby allowing the flapper 53 to close). As the sleeve 55 moves upward, it would force the silicone grease in the upper chamber 61 out through the bleed port 68 (venting to atmosphere). Because the lower chamber 60 in FIG. 5B has a one-way check valve in the port 63, the lower chamber 60 would then remain pressurized, even after the tool is removed from the isolated section (between the BOP). This ensures that the flapper valve 53 would stay closed (unless/until positive action is taken to reopen the flapper valve).

To reopen the flapper 53, there are several possible options. First, the bleed plug 66 could be removed from the lower chamber 60 to vent the fluid pressurizing the lower chamber. This would typically be done by moving the tool out of the well (above the BOP) and allowing the lower chamber 60 to vent to atmosphere (in a similar manner as described above). Without the pressure in the lower chamber 60 creating an upward force on the sleeve 55, the spring 70 may have sufficient force to push the sleeve 55 back down to its first position (thereby opening the flapper 53).

Alternatively, if additional opening force is desired then the upper chamber 61 could be pressurized to provide additional downward force on the sleeve 55. This could be accomplished by closing the bleed port 68 in the upper chamber 61 (via the bleed plug, for example), locating the upper chamber (and more specifically the inlet port 67 of the upper chamber in the section of the well capable of being isolated (typically between two BOP) and isolating the section of well, and then pumping fluid into the isolated section in order to pressurize the upper chamber (with fluid flowing into the upper chamber through the port 67 and providing a downward force on the sleeve 55 due to the area differential in the seals). This force provided by the upper chamber 61 could be used to supplement the spring force. It should also be noted that either the upper or lower chamber could alternatively be pressurized by connecting a pump to the inlet (rather than using the isolated section of well). It should also be noted that in another alternative embodiment, pressurizing the upper chamber 61 may be sufficient to hold the valve open (in which case, a spring may be unnecessary). Regardless, the use of a lower chamber with a pressure-activated closing force (for pushing the sleeve upward into its second position) in conjunction with one or more opening/biasing forces (such as the spring 70 and/or the hydraulic force provided by the pressurized upper chamber 61) may allow for a pressure-activated valve tool that may be repeatedly opened and/or closed without the need for refitting.

Optionally, it may be useful to try to equalize the pressure on both sides of the flapper valve 53 prior to reopening the valve (since otherwise, the valve may experience extreme forces caused by drastic pressure differentials). This could be accomplished by pumping fluid downward through the bore. Alternatively, the flapper valve 53 could be an equalizing valve designed to siphon some of the pressure from the backside of the valve to the front of the valve in an attempt to equalize the pressure on the valve (reducing differential pressure). So for example, during reopening, the sleeve 55 could push downward on an optional ball check valve located near the flapper valve, and that would activate the ball check valve to allow some of the pressure from the backside of the flapper onto the front of the flapper.

The pressure-activated valve tool 50 of FIG. 5A could also be alternatively activated downhole (rather than being brought to the surface). If this type of downhole activation is planned, then typically the pressure-activated valve tool 50 would be modified slightly to aid in downhole activation. Typically, a burst disc would be used to seal one or more inlet ports. In one embodiment, a burst disc would only be used on the inlet port 63 for the lower chamber 60 (in which case, there may be no port 67 for the upper chamber, or the port 67 may be sealed by a cap, so that the upper chamber 61 will not be pressurized at the same time as the lower chamber 60). The bleed port 68 of the upper chamber might also optionally have a collection chamber attached to it (perhaps via a burst disc), to capture the bleed off fluid from the upper chamber if an incompressible fluid is initially used to fill the upper and lower chambers. In this configuration, the well (specifically, the annular space in the well around the tool string) could be pressurized to a level sufficient to burst the burst disc and to then pressurize the lower chamber (to activate the pressure-activated valve for closing). As discussed above, pressurizing the lower chamber (and not the upper chamber) would tend to drive the sleeve 55 upward, allowing the flapper 53 to close. Alternatively, the upper chamber could be initially filled with a compressible fluid, in which case there may be no need for a collection chamber. Regardless, the valve could be remotely activated downhole by pressurizing the annular space in the well (i.e. the area of the well outside the tool string) to activate the flapper valve to close.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings refer to a "Field of Invention," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally" and the like with respect to any element of an embodiment means that the element is not required, or alternatively, the element is required, both alternatives being within the scope of the embodiment(s). Reference in the disclosure to up or down may be made for purposes of description, with "up" or "upper" meaning towards the earth's surface or towards the entrance of a well bore, and "down" or "lower" meaning towards the bottom or terminal end of a well bore.

What is claimed is:

1. A method of operating a hybrid coiled tubing-jointed tubing downhole tool string having a fluid flowpath therethrough in a well, comprising the steps of:

retracting the tool string to place the connection of the coiled tubing to the jointed tubing in a section of the well capable of being isolated, wherein the section of the well capable of being isolated is located between two blowout preventers or between two stripper packers;

isolating the section of the well containing the coiled tubing-jointed tubing connection to allow for pressurization of the section, wherein isolating the section of the well containing the coiled tubing-jointed tubing connection is accomplished using the two blowout preventers or the two stripper packers; and sealing the fluid flowpath within the tubing string at the coiled tubing-jointed tubing connection, wherein sealing the fluid flowpath within the tubing string at the coiled tubing-jointed tubing connection comprises pumping fluid into the isolated section between the two blowout preventers or the two stripper packers;

wherein the fluid flowpath is operable to be sealed by pressurizing the isolated section.

2. The method of claim 1 wherein the coiled tubing-jointed tubing connection comprises a pressure-activated valve tool operable to seal the fluid flowpath, the method further comprising pressurizing the isolated section to seal the fluid flowpath.

3. The method of claim 2 wherein the pressure-activated valve tool comprises a flapper, an upper seal, a lower seal, and a port, and wherein the upper seal has a surface area greater than that of the lower seal.

4. The method of claim 2 wherein the pressure-activated valve tool comprises:

a housing adapted to be made up as part of the tool string and having a longitudinal bore therethrough;

a pressure-activated valve mounted within the housing to control fluid flow through the longitudinal bore, having an open position allowing fluid flow through the bore and a closed position blocking fluid flow through the bore; and a port in the housing allowing application of pressure to the pressure-activated valve;

wherein:

in the absence of sufficient pressure, the pressure-activated valve is open; and the pressure-activated valve is operable to be closed by application of sufficient pressure via the port.

5. The method of claim 4 wherein the further comprising bleeding off fluid pressure in the tool string above the coiled tubing-jointed tubing connection.

6. The method of claim 4, further comprising breaking down the tool string.

7. The method of claim 2 wherein the pressure-activated valve tool comprises:

a housing adapted to be made up as part of the tool string and having a longitudinal bore therethrough;

a flapper mounted within the housing to control fluid flow through the longitudinal bore, having an open position allowing fluid flow through the bore and a closed position blocking fluid flow through the bore;

a sleeve slidably disposed for longitudinal movement within the housing between a first and a second position, such that when the sleeve is located in the first position, the flapper is in the open position, and when the sleeve is located in the second position, the flapper is operable to close;

a middle seal and a lower seal between the sleeve and the housing which together isolate an annular space between the sleeve and the housing;

a port in the housing leading to the annular space; and one or more springs biasing the sleeve towards the first position;

wherein:

the middle seal has a greater surface area than does the lower seal; and the flapper is biased towards the closed position.

8. The method of claim 7 wherein pressure-activated valve tool further comprises an upper seal, such that the upper seal and the middle seal together isolate a second annular space, and the middle seal has a greater surface area than does the upper seal.

9. The method of claim 8, further comprising pressurizing the second annular space to open the fluid flowpath.

10. The method of claim 9 wherein the further comprising bleeding off fluid pressure in the tool string above the coiled tubing-jointed tubing connection.

11. The method of claim 9, further comprising breaking down the tool string.

12. The method of claim 1 wherein the further comprising bleeding off fluid pressure in the tool string above the coiled tubing-jointed tubing connection.

13. The method of claim 1, further comprising breaking down the tool string.

14. The method of claim 1 wherein the isolated well section comprises an annular space around at least a portion of the coiled tubing-jointed tubing connection.

15. A method of bringing up a downhole tool string, with coiled tubing disposed above a pressure-activated valve which is disposed above jointed tubing, from a well, comprising the steps of:

retracting the tool string to place the pressure-activated valve within a section of the well capable of being isolated, wherein the section of the well capable of being isolated is located between two blowout preventers or between two stripper packers;

isolating the section of the well containing the pressure-activated valve to allow for pressurization of the section, wherein isolating the section of the well containing the pressure-activated valve is accomplished using the two blowout preventers or the two stripper packers; and increasing the pressure within the isolated section to a level sufficient to activate the pressure-activated valve, wherein increasing the pressure within the isolated section comprises pumping fluid into the isolated section between the two blowout preventers or between two stripper packers.

16. The method of claim 15, further comprising bleeding off fluid pressure in the tool string above the pressure-activated valve.

17. The method of claim 15, further comprising breaking down the tool string.

18. The method of claim 15 wherein the pressure-activated valve comprises:

a housing adapted to be made up as part of the tool string and having a longitudinal bore therethrough;

a flapper mounted within the housing to control fluid flow through the longitudinal bore, having an open position allowing fluid flow through the bore and a closed position blocking fluid flow through the bore;

a sleeve slidably disposed for longitudinal movement within the housing between a first and a second position, such that when the sleeve is located in the first position, the flapper is in the open position, and when the sleeve is located in the second position, the flapper is operable to close;

a middle seal and a lower seal between the sleeve and the housing which together isolate an annular space between the sleeve and the housing; and a port in the housing leading to the annular space;

wherein:

the middle seal has a greater surface area than does the lower seal; and the flapper is biased towards the closed position.

19. The method of claim 18 wherein the valve further comprises a means to connect a first end of the housing to the coiled tubing and a means to connect a second end of the housing to the jointed tubing.

20. The method of claim 19 wherein the means to connect to coiled tubing comprises a splined quick-connector and a double slip coiled tubing connector.

21. The method of claim 18 wherein the flapper is shielded from wear when located in the open position by the sleeve located in the first position.

22. The method of claim 18 wherein the valve further comprises one or more shear pins which fix the sleeve in the first position and which are operable to shear and release the sleeve if pressure in the annular space rises above a set point.

23. The method of claim 18 wherein the valve further comprises one or more springs biasing the sleeve towards the first position.

24. The method of claim 23 wherein the valve further comprises an upper seal which together with the middle seal isolates a second annular space, and a second port in the housing leading to the second annular space, and wherein the middle seal has a greater surface area than does the upper seal.

25. The method of claim 23, further comprising pressurizing the second annular space to open the fluid flowpath.

26. The method of claim 18 wherein the further comprising bleeding off fluid pressure in the tool string above the coiled tubing-jointed tubing connection.

27. The method of claim 18, further comprising breaking down the tool string.

28. The method of claim 15 wherein the isolated well section comprises an annular space around at least a portion of the pressure-activated valve.

* * * * *